US009121085B2

(12) United States Patent
Kato et al.

(10) Patent No.: US 9,121,085 B2
(45) Date of Patent: Sep. 1, 2015

(54) METHOD FOR MANUFACTURING COMPOSITE METAL ALLOY AND METHOD FOR MANUFACTURING ARTICLE FROM COMPOSITE METAL

(75) Inventors: Atsushi Kato, Nagano (JP); Tomoyuki Sato, Nagano (JP); Kelta Arai, Nagano (JP); Daisuke Shiba, Nagano (JP); Masashi Suganuma, Nagano (JP)

(73) Assignee: NISSEI PLASTIC INSDUSTRIAL CO., LTD. (JP)

( * ) Notice: Subject to any disclaimer, the term of this patent is extended or adjusted under 35 U.S.C. 154(b) by 1980 days.

(21) Appl. No.: 12/284,104

(22) Filed: Sep. 18, 2008

(65) Prior Publication Data

US 2010/0068089 A1 Mar. 18, 2010

(51) Int. Cl.

| | |
|---|---|
| ***C22C 32/00*** | (2006.01) |
| ***B22F 1/00*** | (2006.01) |
| ***B22F 3/04*** | (2006.01) |
| ***C22C 23/02*** | (2006.01) |
| ***B22D 23/00*** | (2006.01) |
| ***C22C 21/00*** | (2006.01) |
| ***C22C 23/00*** | (2006.01) |
| ***C22C 47/02*** | (2006.01) |
| ***C22C 47/08*** | (2006.01) |
| *B22F 3/20* | (2006.01) |

(52) U.S. Cl.

CPC ..... *C22C 23/02* (2013.01); *B22D 23/00* (2013.01); *C22C 21/00* (2013.01); *C22C 23/00* (2013.01); *C22C 32/0052* (2013.01); *C22C 47/02* (2013.01); *C22C 47/08* (2013.01); *B22F 2003/208* (2013.01); *B22F 2998/10* (2013.01)

(58) Field of Classification Search

None

See application file for complete search history.

(56) References Cited

U.S. PATENT DOCUMENTS

| | | | | |
|---|---|---|---|---|
| 2008/0159906 | A1 * | 7/2008 | Suganuma et al. | 420/590 |
| 2009/0074603 | A1 * | 3/2009 | Chan et al. | 419/5 |

FOREIGN PATENT DOCUMENTS

| | | | | |
|---|---|---|---|---|
| JP | 2004-010978 | * | 1/2004 | C22C 32/00 |
| JP | 2006-044970 | * | 8/2004 | C01B 31/02 |
| JP | 2005-068309 | * | 3/2005 | C08L 101/00 |
| JP | WO 2008-139943 | * | 11/2008 | C22C 49/14 |

OTHER PUBLICATIONS

English translation of JP 2006-044970.*
English translation of JP 2005-068309.*
Housh et al, Properties of Magnesium Alloys, 2 ASM Int'l 480-516 (1990).*
English translation of JP 2004-010978 (2004).*

* cited by examiner

*Primary Examiner* — Yoshitoshi Takeuchi
(74) *Attorney, Agent, or Firm* — Adams & Wilks

(57) ABSTRACT

A method for manufacturing a composite metal alloy. An Mg material as an alloy base material and a carbon nanomaterial are mixed together to obtain a mixture in which the Mg material is covered with particles of the carbon nanomaterial. The mixture of the Mg material and carbon nanomaterial are sintered to obtain an Mg sintered compact including the carbon nanomaterial. The Mg sintered compact including the carbon nanomaterial is dissolved to obtain a melt of the composite metal alloy.

17 Claims, 8 Drawing Sheets

METHOD FOR MANUFACTURING COMPOSITE METAL ALLOY AND METHOD FOR MANUFACTURING ARTICLE FROM COMPOSITE METAL

FIELD OF THE INVENTION

The present invention relates to a method for manufacturing an Mg or Al alloy to which a carbon nanomaterial has been added as a reinforcing material, and to a method for using the resulting Mg or Al alloy to manufacture an article formed from a composite metal.

BACKGROUND OF THE INVENTION

Over the past several years, attention has been directed on a special carbon fiber called a "carbon nanofiber" as a reinforcing material, and methods for utilizing this fiber have been proposed. A carbon nanofiber is a sheet rolled into a cylindrical shape containing carbon atoms arranged in the form of a hexagonal mesh, and having a diameter of 1.0 nm (nanometers) to 150 nm. Carbon nanofibers are also called carbon nanotubes, and shall be generically referred to as carbon nanomaterials hereinafter. Carbon nanomaterials are from several to 100 μm in length.

Since carbon nanomaterials are very small, they tend to aggregate and do not readily mix uniformly with a matrix metal used as a base material.

Accordingly, techniques for mixing a ceramic material or a carbon nanomaterial with a low-melting metallic material that is in a semi-molten state and for creating a composite are known, as disclosed in JP 06-238422 A and JP 2004-136363 A.

According to the method for manufacturing a composite metal member disclosed in JP 06-238422 A, a metal material with which a reinforcing material has been admixed is heated and dissolved into a semi-molten state, and then stirred and mixed. The material is then further heated and melted into a liquid state, and thereafter stirred and mixed. The material is then returned to a semi-molten state, again stirred and mixed, and subsequently caused to solidify.

Specifically, the method for manufacturing a composite metal member disclosed in JP 06-238422 A is characterized in that a reinforcing material (a ceramic material) is admixed with a metal material in a semi-molten state.

According to the composite forming method disclosed in JP 2004-136363 A, a melted low-melting metal material is cooled to a semi-molten state having a thixotropic property in which a liquid phase and a solid phase are both present. The low-melting metal material is kneaded in this state with a carbon nanomaterial, and a composite material is obtained. A metal forming machine provided with heating means is used to inject the composite material into a die while maintaining the thixotropic property; and an article formed from composite metal is formed using the die.

Specifically, the composite forming method disclosed in JP 2004-136363 A is characterized in that a reinforcing material (carbon nanomaterial) is kneaded with a low-melting metal material in a semi-molten state.

In either method the metal material is in a semi-molten state; therefore, movement of the added reinforcing material is limited, and aggregation of the reinforcing material can be prevented. As a result, the reinforcing material can be uniformly distributed on the metal material.

However, since the metal material is in a semi-molten state, the added reinforcing material moves at a slow rate, and some time is required before the reinforcing material is moved to all parts of the metal material.

In processes of this type, stirring is generally performed in the presence of argon gas or another inert gas in order to prevent the metal material from oxidizing. Increasing the stirring time heightens the risk that the inert gas will be entrained in the metal material, and leads to a deterioration in the quality of the formed article.

SUMMARY OF THE INVENTION

An object of the present invention is to provide a manufacturing method that can reduce the kneading time performed when a reinforcing material is added.

According to one aspect of the present invention, a method for manufacturing a composite metal alloy is provided, comprising a step for preparing an Mg material or an Al material for constituting an alloy base material, at least one type of alloying material to be added to the Mg material or Al material, and a carbon nanomaterial to be added to the Mg material or Al material; a mixing step for admixing the carbon nanomaterial with the Mg material or the Al material and at least one of the alloying materials, and thereby obtaining a mixture; and a dissolving step for dissolving the mixture and remaining materials together.

According to the abovementioned aspect of the invention, the carbon nanomaterial is admixed with the metal material before the dissolving step. In the dissolving step, the carbon nanomaterial moves through the melt while adhering to the metal material. As a result, the metal material can be dissolved while aggregation of the carbon nanomaterial is minimized. In the dissolving step, the metal material is brought to a completely molten state. As long as the metal material is in a molten state, the carbon nanomaterial can be dispersed in the melt more rapidly than when in a semi-molten state. The dissolving step can be completed in a short time; therefore, the inert gas is entrained in the melt to a lesser extent, and the quality of the article can be improved.

A sintering step for sintering the mixture and obtaining a sintered compact is preferably included between the mixing step and the dissolving step. As long as a powdered mixture is used, scattering will be a problem. According to the present invention, however, as long as the mixture is sintered and made into a sintered compact, scattering can be prevented and safety during storage can be improved. With a sintered compact, furthermore, no concern is presented in regard to movement of the carbon nanomaterial, and aggregation of the carbon nanomaterial can be reliably minimized. Moreover, sintering the mixture and obtaining a sintered compact makes it possible to reduce the surface area. As long as the surface area is small, oxidation and the like can be minimized and the quality can be prevented from deteriorating.

The carbon nanomaterial is preferably composed of a metal-deposited carbon nanomaterial on whose surface a carbide-forming metal including an element that reacts with carbon and generates a compound is caused to adhere. The wettability of the carbon nanomaterial is low; however, the wettability of the carbide-forming element is high. Using a metal-deposited carbon nanomaterial on whose surface this type of carbide-forming element has been caused to adhere allows the wettability of the carbon nanomaterial to be enhanced.

The metal-deposited carbon nanomaterial is preferably obtained by mixing a carbon nanomaterial with a carbide-forming metal, introducing the resulting mixture into a vacuum furnace, and causing the carbide-forming metal to evaporate under a high-temperature vacuum and adhere to the surface of the carbon nanomaterial. The carbide-forming metal generates carbon and a compound, and the compound exhibits a bonding action; therefore, the carbide-forming metal can be securely joined to the carbon nanomaterial.

The carbide-forming metal is preferably Ti or Si. Si and Ti are both metals having melting points allowing vapor deposition to be performed in a vacuum, and have satisfactory wettability with regard to molten matrix metals. Si and Ti are both readily available, and Si in particular is inexpensive; therefore, both enable the method of the present invention to be used more widely, and are preferred.

According to another aspect of the present invention, there is provided a method for manufacturing an article formed from composite metal, comprising a step for directly supplying to a metal forming machine a composite metal alloy, the composite metal alloy being manufactured by a step for preparing an Mg material or an Al material for constituting an alloy base material, at least one type of alloying material to be added to the Mg material or Al material, and a carbon nanomaterial to be added to the Mg material or Al material; a mixing step for admixing the carbon nanomaterial with the Mg material or Al material and at least one of the alloying materials and thereby obtaining a mixture; and a dissolving step for dissolving the mixture and remaining materials together; and a step for bringing the composite metal material into a semi-molten state, and forming the composite metal material in a cavity of a die.

In the method of the present invention according to another aspect, a composite metal material having high wettability is used, and an article formed from composite metal is manufactured. The mechanical and thermal characteristics of the resulting article formed from composite metal can be enhanced. This aspect of the invention is particularly preferred for high-volume production because the composite metal material is directly supplied to a metal forming machine; therefore, production efficiency increases and productivity can be increased.

According to yet another aspect of the present invention, there is provided a method for manufacturing an article formed from composite metal, comprising a step for cooling a composite metal alloy and obtaining a solid composite metal material, the composite metal alloy being manufactured by a step for preparing an Mg material or an Al material for constituting an alloy base material, at least one type of alloying material to be added to the Mg material or Al material, and a carbon nanomaterial to be added to the Mg material or Al material; a mixing step for admixing the carbon nanomaterial with the Mg material or Al material and at least one of the alloying materials and thereby obtaining a mixture; and a dissolving step for dissolving the mixture and remaining materials together; a step for supplying the solid composite metal material to a metal forming machine; a step for heating the solid composite metal material to a semi-molten state; and a step for forming the semi-molten composite metal material in a cavity of a die.

In the method for manufacturing an article formed from composite metal according to this aspect of the invention as well, a composite metal material having high wettability is used, and an article formed from composite metal is manufactured. The mechanical and thermal characteristics of the resulting article formed from composite metal can be enhanced. This aspect of the invention is particularly preferred for low-volume production because the composite metal material is maintained in solid form and supplied to a metal forming machine when necessary; therefore, the degree of latitude in production increases.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
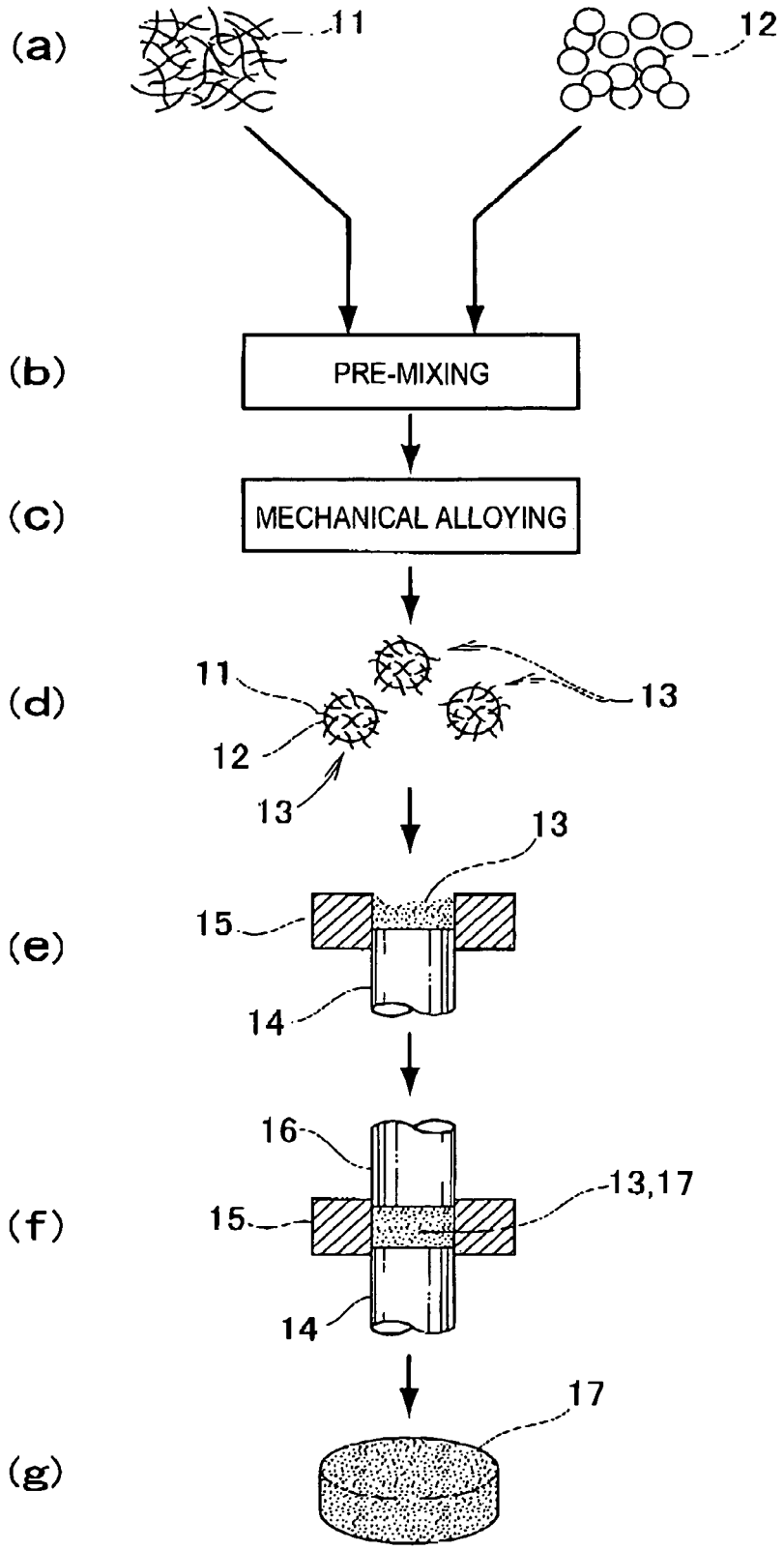
FIG. 1(*a*)-(*g*) are views showing a mixing stop and a sintering step for processing a base material according to an embodiment of the present invention.
Figure 2:
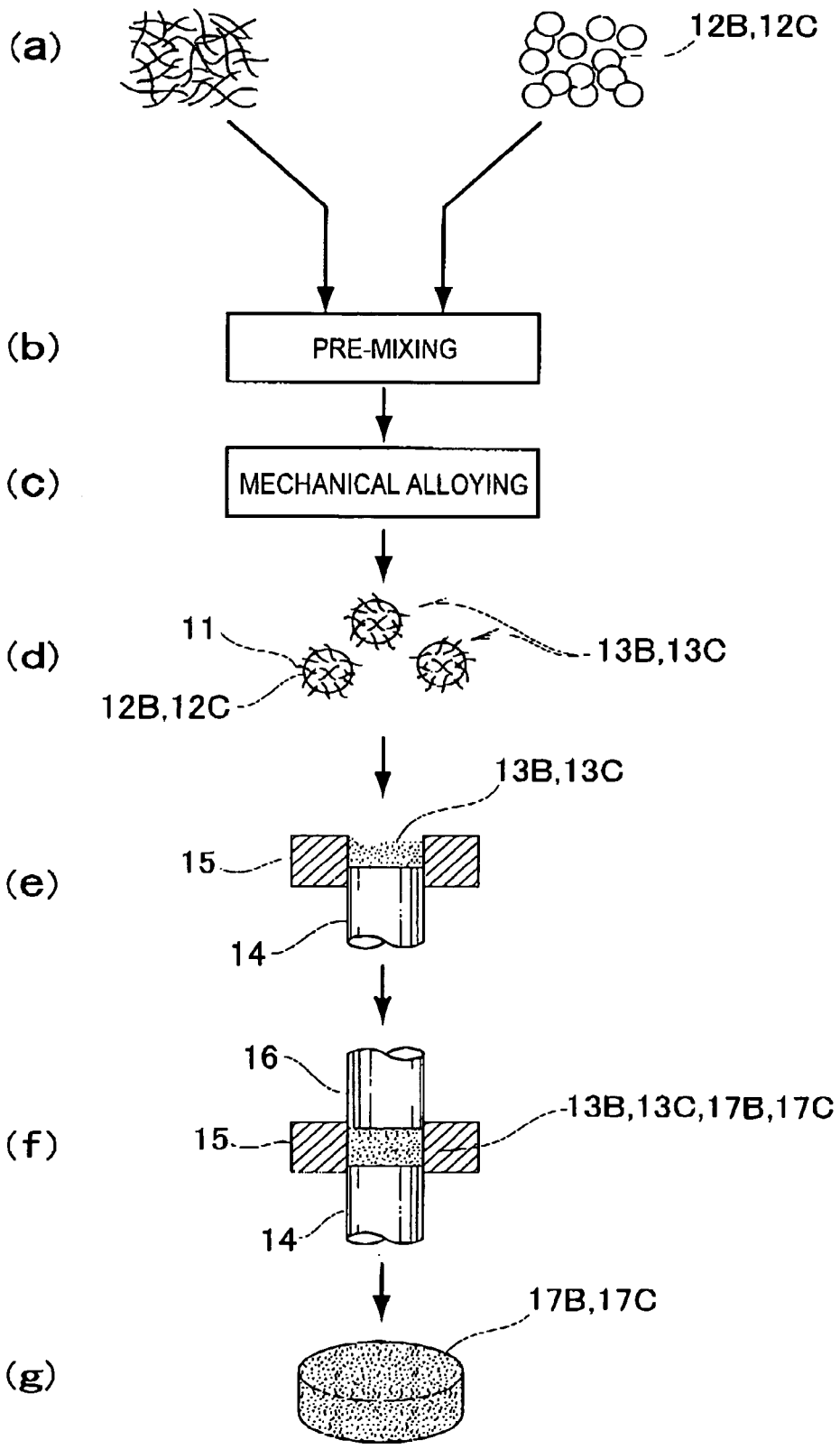
FIG. 2(*a*)-(*g*) are views showing a mixing step and a sintering step for processing an alloying material according to an embodiment of the present invention.
Figure 3:
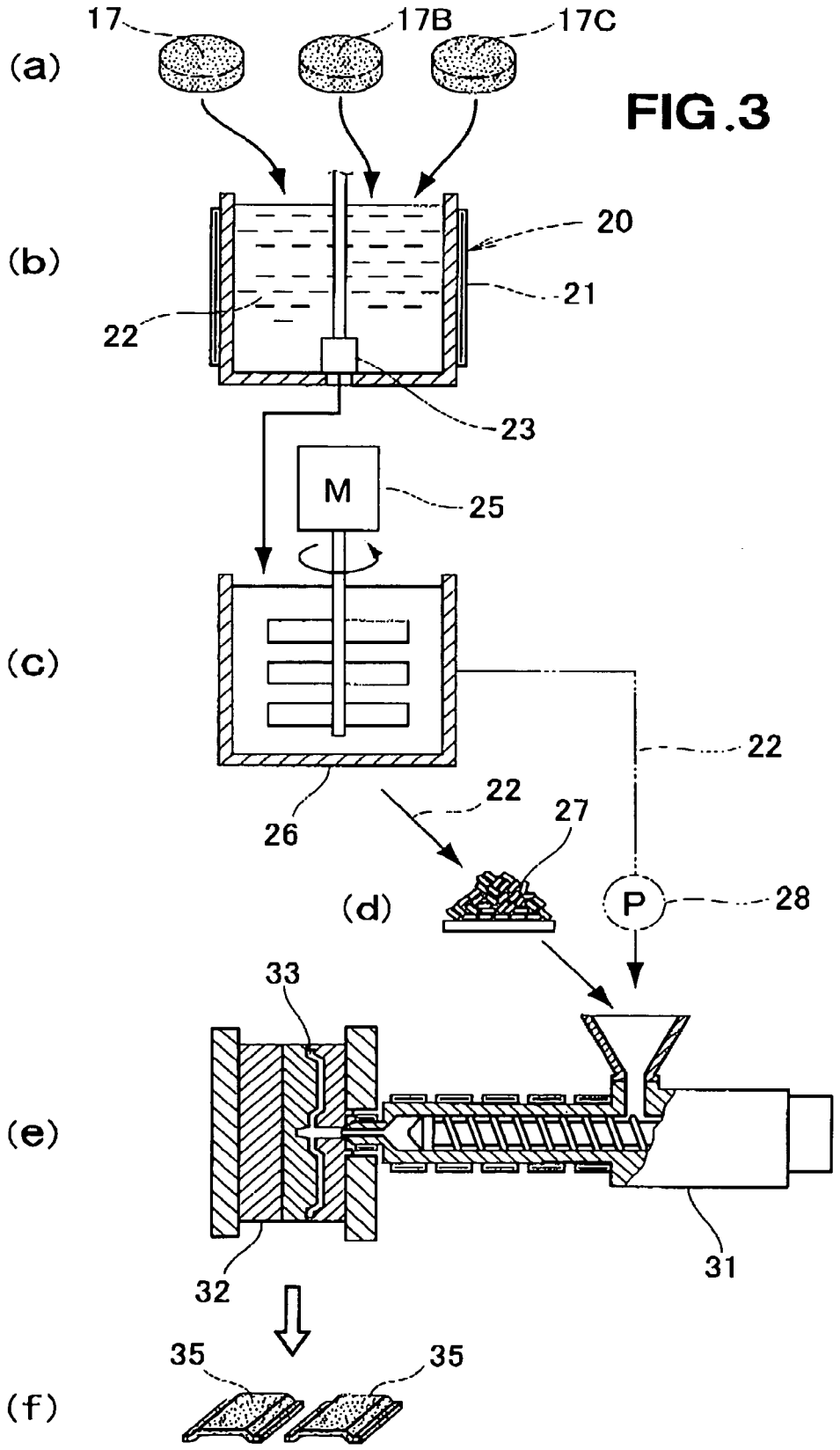
FIG. 3(*a*)-(*f*) are views showing a process according to an embodiment of the present invention, starting from a dissolving step to a step where an article formed from a composite metal is obtained.

Reference is now made to FIGS. 1 to 3 showing one embodiment of the present invention. The metal alloy may be of any type provided that the metal alloy of the present invention is an Mg alloy or an Al alloy. ASTM AZ91D (corresponding to die-cast magnesium alloy JIS H 5303 MDC1D) is cited in the embodiment described below as an example of one of many candidate alloys. The chemical composition of MDC1D as stipulated by JIS is as shown in Table 1.

TABLE 1

| Symbol | Al | Mn | Zn | Si | Cu | Ni | Fe | Other | Mg |
|---|---|---|---|---|---|---|---|---|---|
| MDCID | 8.3-9.7 | 0.15-0.50 | 0.35-1.0 | ≤0.10 | ≤0.03 | ≤0.002 | ≤0.005 | ≤0.02 | Bal. |

MDC1D is a magnesium alloy made from about 9 mass % of Al, 0.5 mass % or less of Mn, and 1.0 mass % or less of Zn as alloying materials; and the remaining approximately 90 mass % of Mg as a base material.

Described below is a method for manufacturing a composite metal alloy having a material that is about 90 mass % Mg (base material); about 9 mass % of Al, 0.5 mass % or less of Mn, and 1.0 mass % of Zn as alloying materials; and a suitable amount of a carbon nanomaterial used as a starting material.

Drawings (a) to (g) of FIG. 1 show a mixing step and a sintering step used to process the base material of the present invention.

FIG. 1(*a*): First, a carbon nanomaterial 11 having a fiber diameter (average value) of 10 nm to 200 nm is prepared, and a powdery Mg material 12 having a grain size (average value) of 200 μm is prepared.

FIG. 1(*b*): Premixing is performed. The premixing is performed by introducing suitable amounts of the carbon nanomaterial 11 and the Mg material 12 into a container and stirring the contents.

FIG. 1(*c*): The carbon nanomaterial 11 and the Mg material 12 are thoroughly kneaded by mechanical alloying. Mechanical alloying is a mechanical mixing method in a broad sense, and refers to a "solid-state alloying method using a high-energy attritor or a ball mill" as stipulated in JIS Z2500, or a "method for using a high-energy mill to mechanically stir, mix, and pulverize a variety of types of starting powders; and use a solid-state reaction to achieve an alloyed state," which is a mechanical alloying method as stipulated by JIS H7004. These methods are universally known); therefore, a description of the apparatus and principles has been omitted.

FIG. 1(*d*): The preceding processes cause the carbon nanomaterial 11 to deaggregate, and yield a mixture 13 in a form in which the Mg material 12 is covered with innumerable particles of the carbon nanomaterial 11. Specifically, FIG. 1(*a*) is a preparation step, and FIGS. 1(*b*) and (*c*) are mixing steps.

FIG. 1(*e*): A die 15 is positioned on a bottom punch 14 of a sintering device, and the mixture 13 is filled into the die 15. A conduction-heating sintering device or a hot press is suitably used for the sintering device.

FIG. 1(*f*): A top punch 16 is inserted into the die 15, and the mixture 13 is compacted, into a solid, while the sintering temperature of the Mg (500° C.) is maintained.

FIG. 1(*g*): An Mg sintered compact 17 including the carbon nanomaterial can thereby be obtained.

FIGS. 1(*e*) and (*f*) are sintering steps.

(a) to (g) of FIG. 2 show the mixing and sintering steps for processing the alloying material of the present invention.

FIG. 2(*a*): The carbon nanomaterial 11 having a fiber diameter (average value) of 10 nm to 200 nm is prepared, powdery Al—Mn alloying material 12B having a grain size (average value) of 200 μm is prepared as an alloying material, and powdery Zn material 12C having a grain size (average value) of 200 μm is prepared as an alloying material. Mn-series aluminum having 90 mass % of Al and 10 mass % of Mn is suitably used for the Al—Mn alloying material 12B.

FIG. 2(*b*): Premixing is performed using a combination of the carbon nanomaterial 11 and the Al—Mn alloying material 12B. Premixing is performed using a combination of the carbon nanomaterial 11 and the Zn material 12C.

FIG. 2(*c*): The carbon nanomaterial 11 and the Al—Mn alloying material 12B are thoroughly kneaded by mechanical alloying. The carbon nanomaterial 11 and the Zn material 12C are thoroughly kneaded by mechanical alloying.

FIG. 2(*d*): The preceding processes cause the carbon nanomaterial 11 to deaggregate, and yield a mixture 13B or 13C in a form in which the Al—Mn material 12B or the Zn material 12C is covered with innumerable particles of the carbon nanomaterial 11. Specifically, FIG. 2(*a*) is a preparation step, and FIGS. 2(*b*) and (*c*) are mixing steps.

FIG. 2(*e*): The die 15 is positioned on the bottom punch 14 of a sintering device, and the mixture 13B or the mixture 13C is filled into the die 15.

FIG. 2(*f*): The top punch 16 is inserted into the die 15, and the mixture 13 is compacted into a solid while the sintering temperature of Al—Mn (500° C.) or the sintering temperature of Zn (300° C.) is maintained.

FIG. 2(*g*): An Al—Mn sintered compact 17B including the carbon nanomaterial, or a Zn sintered compact 17C including the carbon nanomaterial, can thereby be obtained.

FIGS. 2(*e*) and (*f*) show the sintering step.

(a) to (f) of FIG. 3 show the process according to the present invention, starting from the dissolving step to the step where the article formed from composite metal is obtained.

The Mg-sintered compact 17, the Al—Mn-sintered compact 17B, and the Zn-sintered compact 17C shown in FIG. 3*a* are starting materials.

As shown, in FIG. 3*b*, the Mg-sintered compact 17, Al—Mn-sintered compact 17B, and the Zn-sintered compact 17C, either at the same time or successively, are charged into and dissolved in a dissolving furnace 20 provided with heating means 21. A melt 22 of the composite metal alloy can thereby be obtained. Plug means 23 is raised, whereby the melt 22 can be extracted from the dissolving furnace 20.

As shown in FIG. 3(*c*), the melt 22 is transferred to and adequately stirred in a high-temperature tank 26 having stirring means 25. If a bubble-stirring mechanism is attached to the dissolving furnace 20 shown in FIG. 3(*b*), the stirring can be performed inside the dissolving furnace 20. In this case, the high-temperature tank 26 shown in FIG. 3(*c*) can be omitted.

In FIG. 3(*d*), the melt 22 is cooled, and a solid composite metal alloy 27 is obtained. Alternatively, the melt 22 is pumped out of the high-temperature tank 26 by pumping means 28 as shown by the imaginary line in the drawing.

As shown in FIG. 3(*e*), the solid composite metal alloy 27 is supplied to a metal injection machine 31. In the metal injection machine 31, the solid composite metal alloy 27 is changed to a semi-molten state while being kneaded, and is supplied into a cavity 33 of a die 32 by injection. The die 32 is opened after the requisite solidification time has elapsed, whereby a composite metal formed article 35, which is shown in FIG. 3(*f*), is obtained.

Alternatively, as shown in FIG. 3(*e*), the melt 22 pumped out by the pumping means 28 is supplied directly to the metal injection machine 31. In the metal injection machine 31, the melt 22 is changed to a semi-molten state while being kneaded, and is supplied into the cavity 33 of the die 32 by injection. The die 32 is opened after the requisite solidification time has elapsed, whereby the composite metal formed article 35, which is shown in FIG. 3(*f*), is obtained.

The composite metal formed article 35 is additionally hot-rolled and hot-extruded, whereby the metallic texture is made finer, and the mechanical strength and other qualities can be improved.

As shown in FIG. 3(*d*), the procedure performed via the pumping means 28 is called the "direct method," and the procedure performed via the solid composite metal alloy 27 is called the "indirect method."

The direct method offers high productivity, and makes it possible to manufacture carbon nano-composite metal formed articles at low cost; however, the direct method does not facilitate such actions as the changing of materials, and is accordingly suited to low mix/high volume production.

The indirect method is disadvantageous from the standpoint of production capacity, but offers a high degree of latitude in regard to production, and is preferred for high mix/low volume production.

Figure 4:
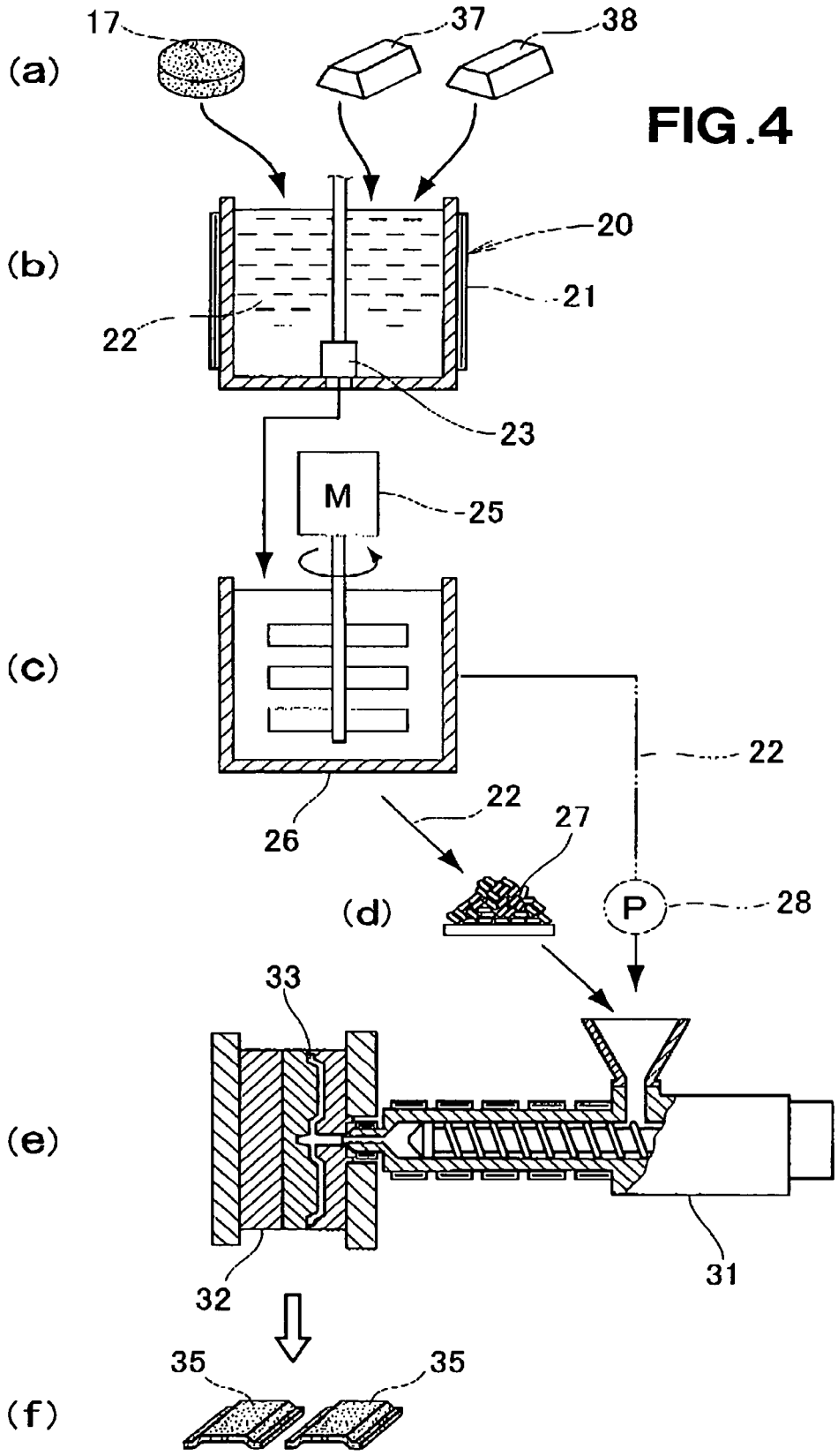
FIG. 4(*a*)-(*f*) show a modification of the process starting from the dissolving step to the step where the article formed from composite metal is obtained, as shown in FIG. 3.

Drawings (a) to (f) of FIG. 4 show a modification of the process starting from the dissolving step to the step where the article formed from composite metal is obtained shown in FIG. 3.

FIG. 4(*a*) shows the preparation of the Mg-sintered compact 17 that includes a carbon nanomaterial, an Al—Mn alloy ingot 37 used as an alloying material, and a Zn ingot 38 used as an alloying material. The ingots 37, 38 are simple cast articles made of alloying materials; therefore, the method for manufacturing the ingots has been omitted.

(b) to (f) of FIG. 4 are the same as described in FIG. 3; therefore the description has been omitted here.

Figure 5:
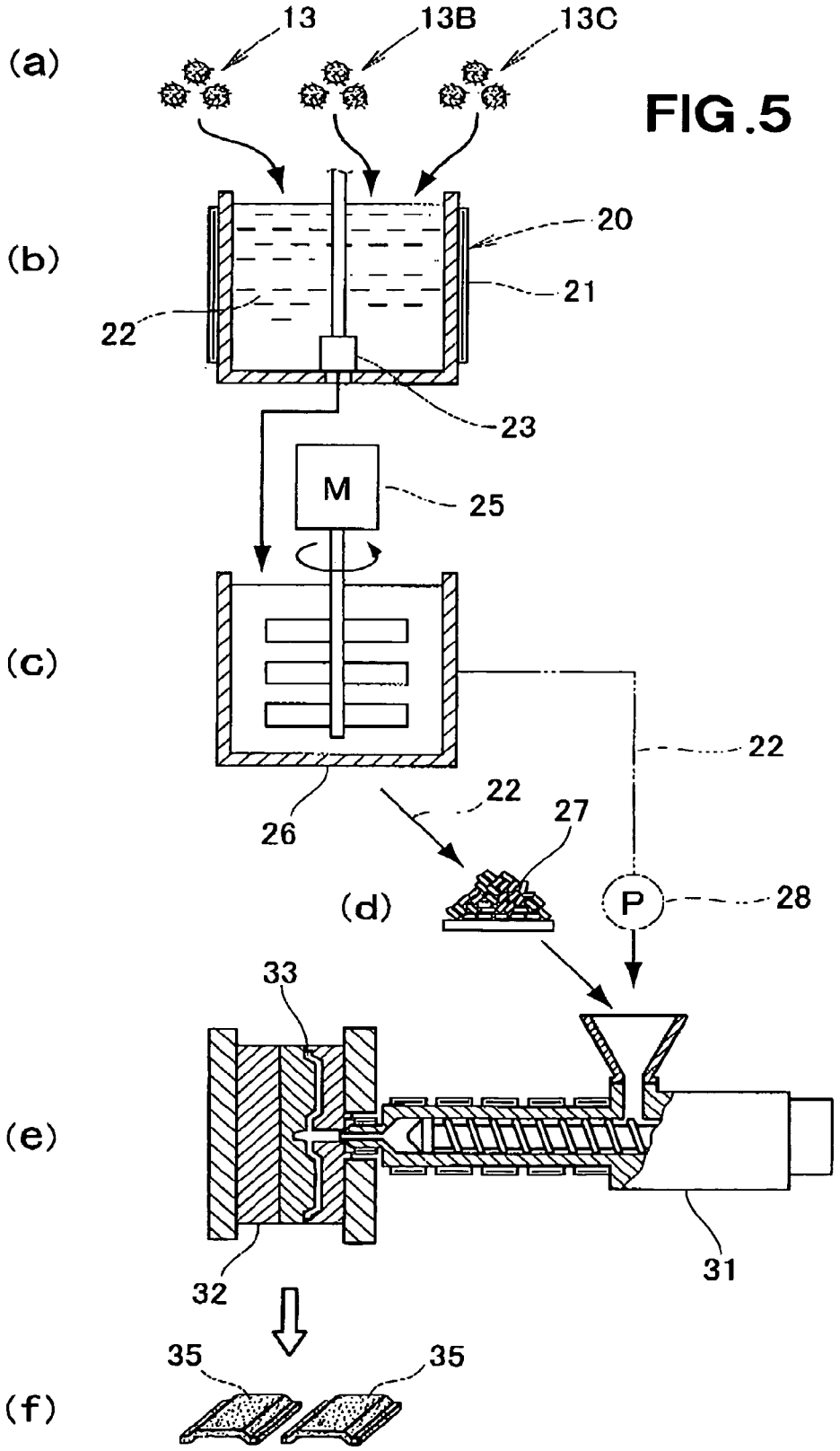
FIG. 5(*a*)-(*f*) show another embodiment of the step for obtaining the article formed from composite metal, as shown in FIG. 3(*a*)-(*f*)

(a) to (f) of FIG. 5 show another embodiment of the step for obtaining an article formed from composite metal shown in FIGS. 3(*a*) to (*f*).

FIG. 5(*a*) shows the preparation of the mixture 13 obtained in the steps shown in FIGS. 1(*a*) to (*d*) and having a form in which the Mg material 12 is covered with innumerable particles of the carbon nanomaterial (see FIG. 1(*d*)); and the mixture 13B or 13C (see FIG. 2(*d*)) obtained in the steps shown in FIGS. 2(*a*) to (*d*) in a form in which the Al—Mn material 12B or the Zn material 12C is covered with innumerable particles of the carbon nanomaterial is prepared.

As shown in FIG. 5(*b*), the mixtures 13, 13B, and 13C, either at the same time or successively, are charged into and dissolved in a dissolving furnace 20 provided with heating means 21. The melt 22 of the composite metal alloy is thereby obtained. Plug means 23 is raised, whereby the melt 22 can be extracted from the dissolving furnace 20.

As shown in FIG. 5(*e*), the melt 22 is transferred to and adequately stirred in a high-temperature tank 26 having stirring means 25. If a bubble-stirring mechanism is attached to the dissolving furnace 20 shown in FIG. 5(*b*), the stirring can be performed inside the dissolving furnace 20. In this case, the high-temperature tank 26 shown in FIG. 5(*c*) can be omitted.

As shown in FIG. 5(*d*), the melt 22 is cooled, and a solid composite metal alloy 27 is obtained. Alternatively, the melt 22 is pumped out of the high-temperature tank 26 by pumping means 28 as shown by the imaginary line in the drawing.

As shown in FIG. 5*e*, the solid composite metal alloy 27 is supplied to a metal injection machine 31. In the metal injection machine 31, the solid composite metal alloy 27 is changed to a semi-molten state while being kneaded, and is supplied into a cavity 33 of a die 32 by injection. The die 32 is opened after the requisite solidification time has elapsed, whereby a composite metal formed article 35, which is shown in FIG. 5(*f*), is obtained.

Alternatively, as shown in FIG. 5(*e*), the melt 22 pumped out by the pumping means 28 is supplied directly to the metal injection machine 31. In the metal injection machine 31, the melt 22 is changed to a semi-molten state while being kneaded, and is supplied into the cavity 33 of the die 32 by injection. The die 32 is opened after the requisite solidification time has elapsed, whereby the composite metal formed article 35, which is shown in FIG. 5(*f*), is obtained.

The improved technique involving the use of carbon nanomaterial 11 shown in FIG. 1(*a*) et al. shall now be described.

Figure 6:
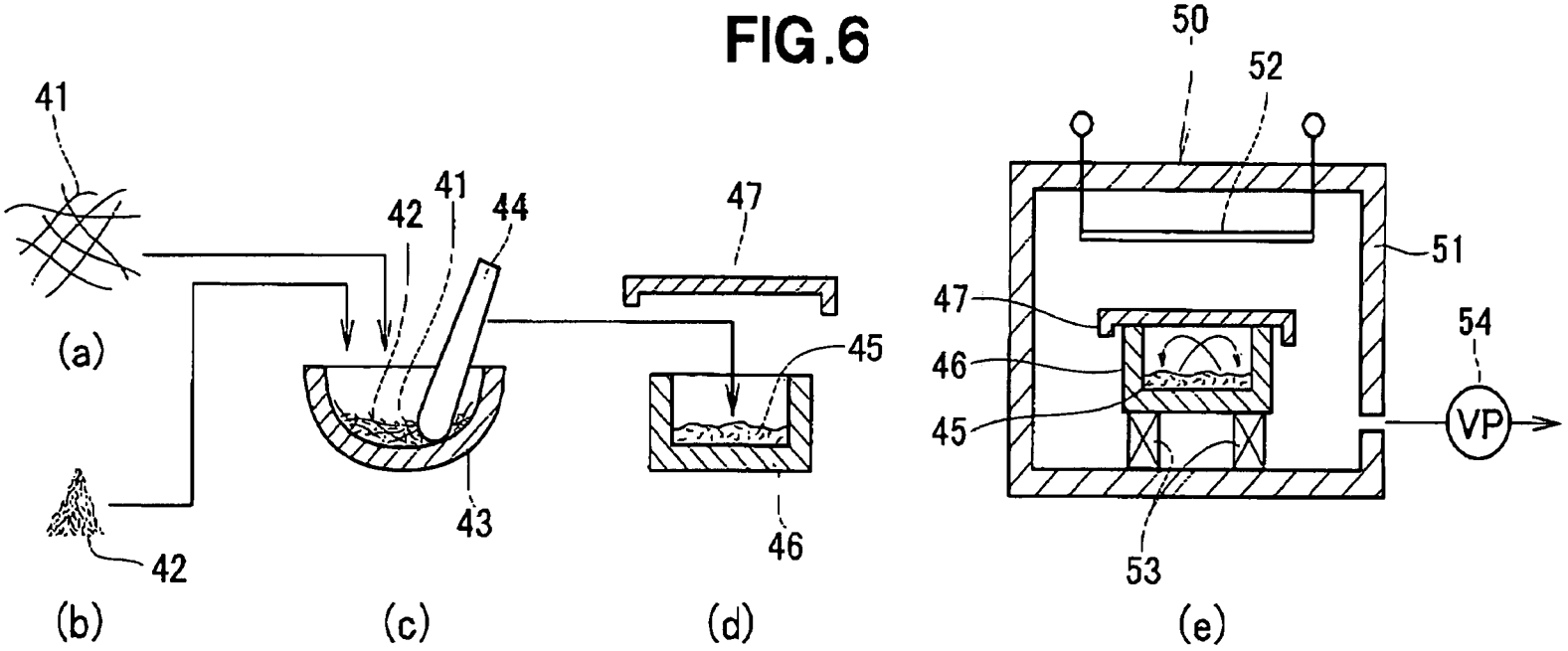
FIG. 6(*a*)-(*e*) are views showing a step for surface-treating the carbon nanomaterial.

(a) to (e) of FIG. 6 show a step for surface-treating the carbon nanomaterial FIG. 6(*a*): a carbon nanomaterial 41 is prepared in an amount of, e.g., 10 g. The carbon nanomaterial 41 may be the same as the carbon nanomaterial 11 shown in FIG. 1(*a*) et al.; however, the symbol has been changed for convenience.

FIG. 6(*b*): a Si powder 42 is prepared as a carbide-forming element in an amount of, e.g., 1 g.

FIG. 6(*c*): the carbon nanomaterial 41 and the Si powder 42 are placed in a mortar 43, and mixed for 15 to 30 minutes using a pestle 44.

FIG. 6(*d*): a resulting mixture 45 is introduced into an aluminum container 46 that is then covered using an aluminum lid 47. An unsealed lid is used as the aluminum lid 47, whereby air is allowed to pass in and out of the container 46.

FIG. 6(*e*): a vacuum furnace 50 having a sealed furnace 51, heating means 52 for heating the inside of the furnace 51, a stand 53 on which the container 46 is placed, and a vacuum pump 54 for evacuating the interior of the furnace 51 are prepared. The container 46 is introduced into the vacuum furnace 50.

Figure 7A:
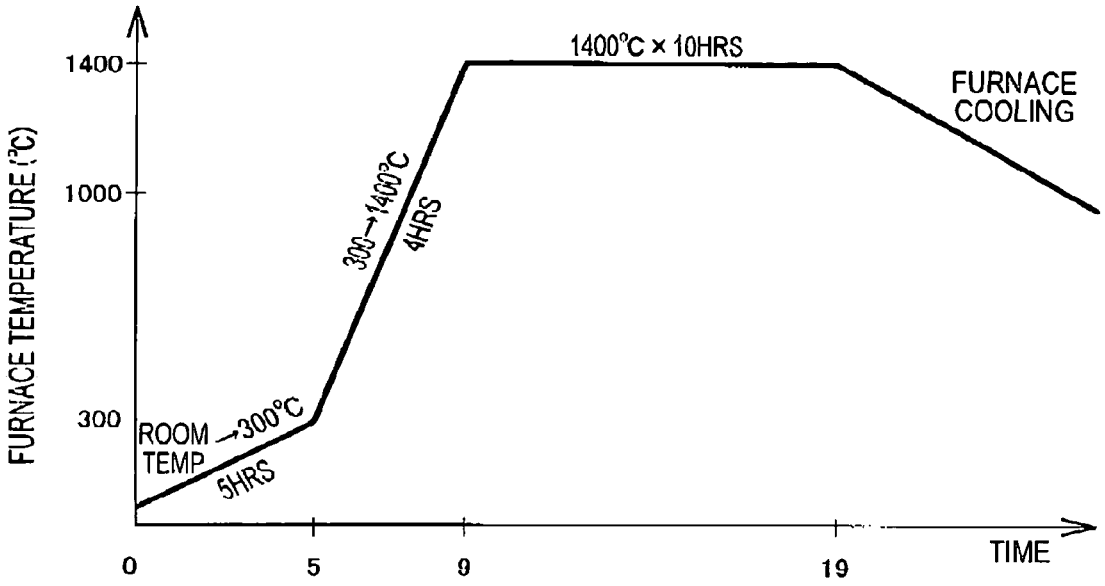
FIGS. 7A and B are graphs showing a furnace temperature and inner pressure in relation to the Si.
Figure 7B:
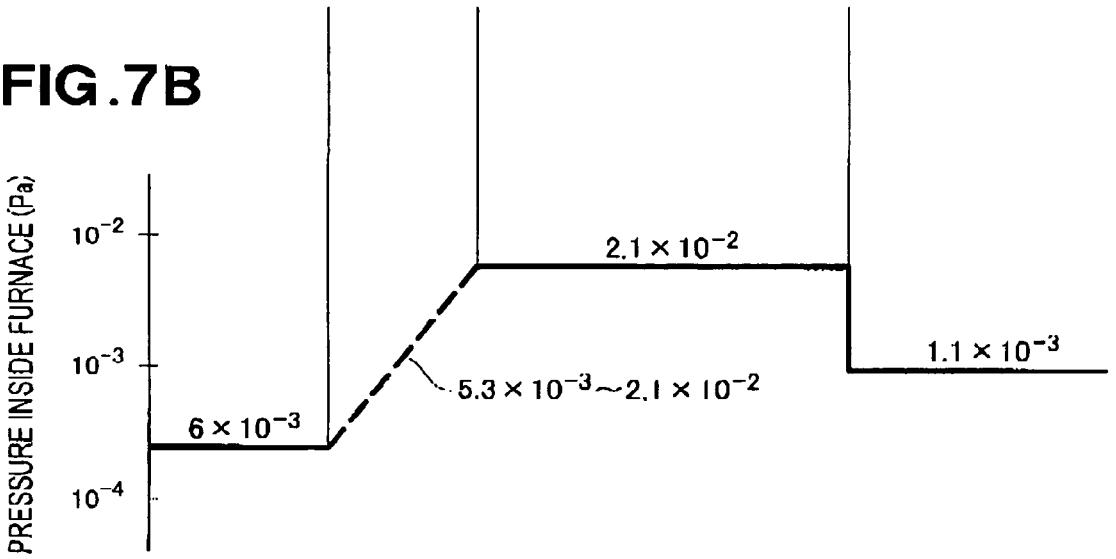

The conditions under which heating and pressurization are performed in the vacuum furnace 50 are shown by FIGS. 7A and 7B; the Si powder in the mixture 45 is heated in a vacuum and thereby caused to evaporate. The resulting vapor bubbles through the space defined by the container 46 and the lid 47. This action is known as bubble stirring. The carbon nanomaterial is loosened by the bubble stirring; and the Si vapor comes into contact with the surface of the loosened carbon nanomaterial, forms a compound, and adheres in the form of Si microparticles.

Taken all together, FIGS. 6(*a*) to 6(*c*) show a step for mixing the metallic powder 42, which includes an element that reacts with carbon and generates a chemical compound, with the carbon nanomaterial 41; and a vapor deposition step in which the resulting mixture 45 is introduced into the vacuum furnace 50, the metallic powder 42 is caused to evaporate under a high-temperature vacuum, and the vapor is caused to adhere to the surface of the carbon nanomaterial 41.

FIGS. 7A and 7B are graphs of the furnace temperature and inner pressure in relation to the Si, with the horizontal axis showing the time, and the vertical axes showing the furnace temperature and inner pressure.

At a degree of vacuum of $6\times10^{-3}$ Pa, the furnace temperature is raised from room temperature to 300° C. over five hours.

At a degree of vacuum of $5.3\times10^{-3}$ to $2.1\times10^{2}$ Pa, the furnace temperature is raised from 300° C. to 1400° C. over four hours.

Conditions are maintained for ten hours at 1400° C. and a degree of vacuum of $2.1\times10^{-2}$ Pa.

The melting point of Si is 1427° C.; therefore, a temperature just below the melting point (1350° C. to 1400° C.) is maintained, and the Si is held in a state of saturated vapor pressure at this temperature. At 1350° C. the saturated vapor pressure is about $1.3\times10^{3}$ Pa, and at 1400° C. the saturated vapor pressure is about $2.1\times10^{-2}$ Pa. These approximate degrees of vacuum can be readily attained using a vacuum furnace, and therefore a processing temperature of 1350° C. to 1400° C. is suitable. However, the evaporation rate at 1350° C. is low, and the evaporation rate at 1400° C. is high; therefore, the processing temperature in the present embodiment is 1400° C.

SiC (silicon carbide), which is a compound of Si and carbon, will be described below. The standard free energy of formation of SiC is −39.6 kJ/mol at 1400° C., and since this condition can be met, Si vapor is thought to react with the carbon in the carbon nanomaterial and form SiC.

Therefore, should the mixture be introduced into a semi-sealed container, and the Si powder caused to evaporate, bubble stirring will occur, and Si microparticles can be caused to adhere to the carbon nanomaterial.

The conditions are maintained for long period of time; i.e., 10 hours, in order for stirring and reacting to be adequately performed. It shall be apparent that the time over which the conditions are maintained may be increased or decreased according to the mixture ratio, the throughput, and other conditions.

The heating means shuts down after 19 hours; however, furnace cooling is performed while a degree of vacuum of $1.1\times10^{-3}$ Pa is maintained. Furnace cooling is a method for gradually cooling the manufactured articles.

Figure 8:
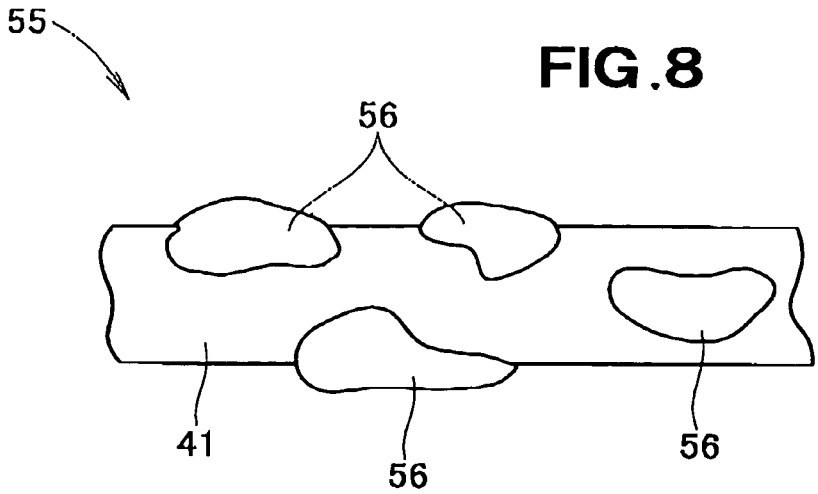
FIG. 8 is an enlarged view of the metal-deposited carbon nanomaterial.

FIG. 8 shows a carbon nanomaterial with a metal-adhering thereto and manufactured by the method of the present invention.

A metal-deposited carbon nanomaterial 55 is composed of the deaggregated carbon nanomaterial 41, and numerous Si microparticles 56 that have uniformly adhered to the surface of the carbon nanomaterial 41. As previously described, the Si microparticles 56 are formed by crystallizing Si, which is an element that reacts with carbon and generates a chemical compound.

It is important that the Si microparticles 56 adhere to the carbon nanomaterial 41 with the carbide SiC interposed therebetween. Since the carbon nanomaterial 41 has poor wettability, a concern is presented that the contact strength would be inadequate if the Si microparticles were used alone. In this regard, causing Si microparticles to adhere to the surface of the carbon nanomaterial 41 enables a SiC reation layer to form at the interface, and the Si microparticles 56 can be securely adhered to the carbon nanomaterial 41.

The previously mentioned metal-deposited carbon nanomaterial 55 may be used in place of the carbon nanomaterial 11 shown in FIG. 1(*a*), and the metal-deposited carbon nanomaterial 55 and the Mg material 12 mixed together in an adequate amount. The carbon nanomaterial 11 may be substituted in FIG. 2(*a*) as well.

In the present embodiment, even if the Si used as a carbide-forming metal (an element that reacts with metallic carbon and generates a compound) is substituted for Ti, the same effect in terms of an improvement in mechanical strength can be obtained, although a detailed description thereof is omitted. Furthermore, in addition to Si and Ti, Zr (zirconium) and V (vanadium) can be employed for use in forming a carbide.

However, Si and Ti are both readily available, and Si in particular is inexpensive; therefore, both enable the method of the present invention to be used more widely, and are preferred.

In addition to Mg and Mg alloys having a melting point of about 650° C., Al and Al alloys having a melting point of 660° C. are preferred for use as the base material metallic material.

Mg, Al, and alloys formed from each of these elements are light-weight metals, and by including a carbon nanomaterial in these metals and increasing mechanical strength, it becomes possible to provide a light-weight structural material of exceptional strength, thermal conductivity and abrasion resistance.

Based on the above description, the present invention can be summarized in the following manner.

According to a first aspect of the present invention, there is provided a method for manufacturing a composite metal alloy, comprising a material preparation step for preparing an Mg material or an Al material for constituting an alloy base material, at least one type of alloying material to be added to the Mg material or Al material, and a carbon nanomaterial to be added to the Mg material or Al material (see FIG. 1(*a*), FIG. 2(*a*), and FIG. 4(*a*)); a mixing step for admixing the carbon nanomaterial with the Mg material or the Al material and at least one of the alloying materials, and thereby obtaining a mixture (see FIGS. 1(*b*) and (*c*), and FIGS. 2(*b*) and (*c*)); and a dissolving step for dissolving the mixture and remaining materials together (see FIG. 3(*b*), FIG. 4(*b*), and FIG. 5(*b*).

According to the first aspect of the present invention, a sintering step for sintering the mixture and obtaining a sintered compact is additionally included between the mixing step and the dissolving step (see FIGS. 1(*e*) and (*f*), and FIGS. 2(*e*) and (*f*).

According to the first aspect of the present invention, as shown in FIG. 8, the carbon nanomaterial is a metal-deposited carbon nanomaterial that is obtained by causing a carbide-forming metal including an element that reacts with carbon and generates a compound to adhere to the surface of the carbon nanomaterial.

According to the first aspect of the present invention, as shown in FIGS. 6 and 7, the metal-deposited carbon nanomaterial is obtained by mixing a carbon nanomaterial with a carbide-forming metal, introducing the resulting mixture into a vacuum furnace, and causing the carbide-forming metal to evaporate under a high-temperature vacuum and adhere to the surface of the carbon nanomaterial.

According to the first aspect of the present invention, the carbide-forming metal is Ti or Si.

According to a second aspect of the present invention, an article formed from composite metal is manufactured by directly supplying to a metal forming machine the composite metal alloy manufactured according to FIG. 3(*c*) to (*e*), FIG. 4(*c*) to (*e*), and FIG. 7(*c*) to (*e*), and using a die cavity to form the composite metal alloy while in a semi-molten state.

According to a third aspect of the present invention, an article formed from composite metal is manufactured through a step for obtaining a solid composite metal material by cooling the composite metal alloy manufactured according to FIG. 3(*c*) to (*e*), FIG. 4(*c*) to (*e*), and FIG. 7(*c*) to (*e*); and a step for supplying the solid composite metal material to a metal forming machine, bringing the composite metal material to a semi-molten state, and forming the composite metal material using a die cavity.

A step for stirring the composite metal alloy while the alloy is maintained in a semi-molten state may be added after the invention according to the first aspect and before the invention according to the second or third aspect. Adding this step allows even greater dispersion of the carbon nanomaterial to occur.

The [type of] alloying material is determined according to the additive elements required for the desired composite metal alloy, and thus is not limited to Al—Mn and Zn.

The present invention is an Mg alloy or an Al alloy for use in injection molding, and is preferred for use in a method for manufacturing Mg alloy or Al alloy to which a carbon nanomaterial is added.

Obviously, various minor changes and modifications of the present invention are possible in light of the above teaching. It is therefore to be understood that within the scope of the appended claims the invention may be practiced otherwise than as specifically described.

What is claimed is:

1. A method for manufacturing a composite metal alloy, comprising the steps of:

providing an Mg material as an alloy base material;

providing a carbon nanomaterial;

mixing the carbon nanomaterial with the Mg material to obtain a mixture in which the Mg material is covered with particles of the carbon nanomaterial;

sintering the mixture of the Mg material and carbon nanomaterial to obtain an Mg sintered compact including the carbon nanomaterial; and dissolving the Mg sintered compact to obtain a melt of the composite metal alloy.

2. A manufacturing method of claim 1, wherein the carbon nanomaterial comprises a metal-deposited carbon nanomaterial obtained by causing a carbide-forming metal including an element that reacts with carbon and generates a compound to adhere to the surface of the carbon nanomaterial.

3. A manufacturing method according to claim 2, wherein the carbide-forming metal is Si.

4. A manufacturing method according to claim 2, wherein the carbide-forming metal is Ti.

5. A manufacturing method of claim 1, wherein the carbon nanomaterial comprises a metal-deposited carbon nanomaterial obtained by mixing a carbon nanomaterial with a carbide-forming metal, introducing the resulting mixture into a vacuum furnace, and causing the carbide-forming metal to evaporate under a high-temperature vacuum and adhere to the surface of the carbon nanomaterial.

6. A manufacturing method of claim 4, wherein the carbide-forming metal is Si.

7. A manufacturing method according to claim 5, wherein the carbide-forming metal is Ti.

8. A manufacturing method according to claim 1, further comprising the step of cooling the melt of the composite metal alloy to obtain a solid composite metal alloy.

9. A manufacturing method according to claim 1, wherein the carbon nanomaterial has an average particle diameter of 10 nm to 200 nm.

10. A manufacturing method according to claim 1, wherein the Mg material has an average grain size of 200 μm.

11. A method for manufacturing a composite metal alloy, comprising the steps of:

providing an Mg alloy made of Mg as a base material;

forming a metal-deposited carbon nanomaterial by causing a carbide-forming metal including an element that reacts with carbon and generates a compound to adhere to the surface of a carbon nanomaterial;

mixing the metal-deposited carbon nanomaterial with the base material to obtain a mixture in which the base material is covered with particles of the metal-deposited carbon nanomaterial;

sintering the mixture to obtain a compact;

dissolving the compact to obtain a melt; and cooling the melt to obtain a composite metal alloy.

12. A manufacturing method according to claim 11, wherein the Mg alloy contains Al, Mn and Zn as alloying materials.

13. A manufacturing method according to claim 11, wherein the metal-deposited carbon nanomaterial has an average particle diameter of 10 nm to 200 nm.

14. A manufacturing method according to claim 13, wherein the base material has an average grain size of 200 μm.

15. A manufacturing method according to claim 11, wherein the base material has an average grain size of 200 μm.

16. A manufacturing method according to claim 11, wherein the carbide-forming metal is Si.

17. A manufacturing method according to claim 11, wherein the carbide-forming metal is Ti.

* * * * *

UNITED STATES PATENT AND TRADEMARK OFFICE

CERTIFICATE OF CORRECTION

PATENT NO. : 9,121,085 B2
APPLICATION NO. : 12/284104
DATED : September 1, 2015
INVENTOR(S) : Atsushi Kato et al.

It is certified that error appears in the above-identified patent and that said Letters Patent is hereby corrected as shown below:

On the Title Page:

In the Inventors, item (76), "Kelta Arai"

should be changed to -- Keita Arai --.

Signed and Sealed this
Twenty-third Day of August, 2016

Michelle K. Lee

Michelle K. Lee
*Director of the United States Patent and Trademark Office*